US012630355B2

(12) United States Patent
Maschio et al.

(10) Patent No.: US 12,630,355 B2
(45) Date of Patent: May 19, 2026

(54) COLUMN STORAGE SYSTEM FOR AGRICULTURAL MACHINES

(71) Applicant: MASCHIO GASPARDO S.P.A., Campodarsego (IT)

(72) Inventors: Andrea Maschio, Morsano al Tagliamento (IT); Manuel Michelin, Pradamano (IT)

(73) Assignee: MASCHIO GASPARDO S.P.A., Campodarsego (IT)

( * ) Notice: Subject to any disclaimer, the term of this patent is extended or adjusted under 35 U.S.C. 154(b) by 0 days.

(21) Appl. No.: 18/835,470

(22) PCT Filed: Feb. 8, 2023

(86) PCT No.: PCT/IB2023/051110
§ 371 (c)(1),
(2) Date: Aug. 2, 2024

(87) PCT Pub. No.: WO2023/152649
PCT Pub. Date: Aug. 17, 2023

(65) Prior Publication Data

US 2025/0145365 A1 May 8, 2025

(30) Foreign Application Priority Data

Feb. 8, 2022 (IT) ..... 102022000002282

(51) Int. Cl.
*B65D 85/68* (2006.01)

(52) U.S. Cl.
CPC ..... *B65D 85/68* (2013.01); *B65D 2585/688* (2013.01)

(58) Field of Classification Search
CPC . B60P 7/12; B65D 2519/00815; B65D 85/62; B65D 2585/688; B65D 2585/6802; B65D 2585/6877; B65D 2585/6875
See application file for complete search history.

(56) References Cited

U.S. PATENT DOCUMENTS 5,413,224 A * 5/1995 Marron ..... B65D 19/18 206/335
10,323,623 B2 * 6/2019 Klein ..... B65D 85/68
(Continued)

FOREIGN PATENT DOCUMENTS

CN 214818483 U 11/2021
DE 4335544 A1 * 3/1994 ..... E04G 5/00
(Continued)

OTHER PUBLICATIONS

Search Report & Written Opinion issued in PCT/IB2023/051110 (Mar. 28, 2023).

*Primary Examiner* — Patrick D Hawn
(74) *Attorney, Agent, or Firm* — Barnes & Thornburg; Steven D. Shipe

(57) ABSTRACT

A column storage system for agricultural machines comprises a ground support structure, a first machine which is supported on the ground support structure, at least a second machine which is arranged in a vertically higher position with respect to the first machine, a connection device which is interposed between the machines so as to support the second machine overlapping the first machine, and reversible connection means which are configured to removably fix the connection device to the machines.

20 Claims, 2 Drawing Sheets

(56) References Cited

U.S. PATENT DOCUMENTS

| | | | | |
|---|---|---|---|---|
| 11,230,428 | B2 * | 1/2022 | Bublitz | B65D 85/62 |
| 11,939,954 | B2 * | 3/2024 | Stuart | F03D 13/40 |
| 2007/0051654 | A1 * | 3/2007 | Mahoney | B65D 85/62<br>206/499 |
| 2007/0189872 | A1 * | 8/2007 | Omuta | B65D 85/68<br>410/24 |
| 2010/0232926 | A1 | 9/2010 | Awad | |
| 2018/0044101 | A1 * | 2/2018 | Robinson | B65D 85/62 |
| 2018/0111750 | A1 | 4/2018 | Klein et al. | |
| 2019/0100350 | A1 | 4/2019 | Kolecki et al. | |

FOREIGN PATENT DOCUMENTS

| | | | | |
|---|---|---|---|---|
| DE | 4336043 | A1 * | 4/1995 | A47B 81/00 |
| FR | 2856667 | A1 * | 12/2004 | B65D 19/12 |
| GB | 2350351 | A * | 11/2000 | B65D 85/68 |

* cited by examiner

COLUMN STORAGE SYSTEM FOR AGRICULTURAL MACHINES

CROSS REFERENCE TO RELATED APPLICATIONS

This application is a U.S. nationalization under 35 U.S.C. § 371 of International Application No. PCT/IB2023/051110, filed 8 Feb. 2023, which claims priority to Italian Patent Application No. 102022000002282, filed 8 Feb. 2022. The disclosures set forth in the referenced applications are each incorporated herein by reference in their entirety.

TECHNICAL FIELD

The present invention relates to a column storage system for agricultural machines.

TECHNOLOGICAL BACKGROUND

In order to make it easier to store and transport agricultural machines, they can be positioned one above the other on shelves of suitable racks.

One example of a rack may comprise a support structure which extends vertically from the ground. There project from the support structure pairs of horizontal beams which are intended to support the rotary tillers. In this manner, the rotary tillers can be stored in a column so as to minimize the spatial requirement.

Although this solution considerably reduces the shipping costs for the rotary tillers, it has a number of disadvantages. In fact, the rack of the example cited is quite heavy and bulky so that the assembly thereof is rather complex and the manufacture thereof involves a substantial consumption of material.

Furthermore, the known racks have a fixed capacity which is given by the height of the support structure and the number of shelves available. Conversely, it would be desirable to provide a support system, the capacity of which can be adapted as a function of the number of machines to be stored.

Examples of conventional storage systems are described in US2019/100350A1 or CN214818483U.

DESCRIPTION OF THE INVENTION

The problem addressed by the present invention is to provide a column storage system for agricultural machines which is structurally and functionally configured to overcome, at least partially, one or more of the disadvantages set out above with reference to the cited prior art.

This problem is solved by the present invention by means of a column storage system for agricultural machines comprising a ground support structure, a first machine which is supported on the ground support structure, at least a second machine which is arranged in a vertically higher position with respect to the first machine, and a column connection device between the first and the second machines.

The connection device is preferably interposed between the first and the second machines so as to support the second machine overlapping the first machine. In some embodiments, the connection device comprises a plurality of connection elements which extend longitudinally from the first machine to the second machine.

Preferably, the storage system further comprises connection means between the connection device and the first and second machines. More particularly, the connection means are reversible and are configured to removably fix the connection device to the first and second machines. The reversible connection means may comprise, for example, threaded means, retaining pins and/or where applicable a form-fitting connection between corresponding shapes which are formed in the machines and in the connection device, respectively.

Advantageously, the connection device is fixed directly to the first machine, by means of which the connection device is fixed indirectly to the ground support structure. In this manner, the first machine contributes to providing the support structure of the second machine. With respect to a conventional rack, this involves a substantial saving of material and a reduction in weight and the dimensions of the support structure of the machines.

The machines may have different forms and dimensions. In some embodiments, each of the machines, when viewed from above, preferably extends longitudinally and preferably defines a perimeter, at the vertices of which a plurality of connection elements are arranged, preferably four connection elements. In this manner, the weight of the second machine is distributed over an adequate number of connection elements which are spaced apart from each other in order to increase the structural stability of the system.

Although having four connection elements may be advantageous in terms of stability of the structure, it must be observed that a single connection element, if it has suitable dimensions in accordance with the load to be supported, is also sufficient to isostatically fix one machine above the other (for example, consider a single-legged chair): it is not necessary for the chair to have four legs in order to stand). In fact, some machines are more compact than others and can therefore be fixed by means of a single connection element as an alternative to a plurality of thinner connection elements. Furthermore, in some embodiments, there can be two connection elements which are each arranged, for example, at one of the two opposite longitudinal ends of the respective machine. In some embodiments, therefore, there can be less than four connection elements, for example, one, two or three, or there may also be a number greater than four. The person skilled in the art will have no difficulty in sizing the connection elements as a function of the load to be supported.

Naturally, the connection element(s) can be arranged in different positions on the machines. Although the connection elements being arranged at the vertices of the perimeter of the machines may confer greater stability on the structure, it must be observed that the connection elements can also be fixed inside the perimeter of the machines.

For greater stability, it is preferable for the connection elements to be spaced apart from each other, particularly along the longitudinal extent of the respective machine and/or transversely relative to the longitudinal extent of the respective machine. It may be noted that fixing the connection elements inside the perimeter of the machines does not prevent the connection elements from being spaced apart from each other.

In some embodiments, the connection elements are fixed to the central body of the machines in an intermediate position between the longitudinal ends thereof and are preferably uniformly spaced apart along the longitudinal extent of the respective machine.

In some embodiments, each machine comprises a central body which extends longitudinally and a pair of plates which are arranged transversely relative to the longitudinal development of the central body. The plates are preferably fixed to the opposing longitudinal ends of the central body and, still in a preferable manner, the connection elements are fixed to the plates, in particular two per plate. In this manner, the plates contribute to providing the support structure of the machines.

Preferably, the plates have first apertures facing second apertures formed in the connection elements in order to receive the reversible connection means therein. More particularly, the reversible connection means engage with the mutually facing first and second apertures so as to removably connect the plates to the corresponding connection elements.

It is preferable for the first and/or second apertures to be in the form of holes, particularly through-holes. It is further preferable for the holes of the first and second mutually facing apertures to be coaxial.

In some embodiments, the connection elements are constituted by metal profiles having an L-shaped section in which there are defined a first side adhering to the plates and a second side transverse with respect to the first side. Preferably, the second apertures are defined at the first side. In this manner, the second side rigidifies the first side and, at the same time, allows the connection means of the second apertures to be maneuvered both by means of a tool which extends axially from the second apertures and by means of a tool which extends transversely to the axis of the second apertures.

The plates preferably have a vertical development and, still in a preferable manner, each have a lower longitudinal end and an upper longitudinal end which are opposite each other and at which there are defined at least a first lower aperture for fixing a connection element which is arranged below the plate and at least a first upper aperture for fixing a connection element which is arranged above the plate, respectively.

The connection elements also preferably have a vertical development and, in a preferred example, each have a lower longitudinal end and an upper longitudinal end which are opposite each other and at which there are defined at least a second lower aperture facing the at least one first upper aperture of a plate which is arranged below the connection element and at least a second upper aperture facing the at least one first lower aperture of a plate which is arranged above the connection element in order to receive the reversible connection means therein, respectively. In this manner, the lower and upper longitudinal ends of the connection elements can be connected to the upper longitudinal end and to the lower longitudinal end, respectively, of vertically consecutive plates of the first and second machines, respectively.

In a preferred embodiment, at least one of the opposing longitudinal ends of each connection element and at least one of the opposing longitudinal ends of each plate have a pair of second apertures and a pair of first apertures, respectively, which face each other in order to receive the reversible connection means therein so as to secure the connection elements to the plates without any capacity for relative rotation, that is to say, preventing the connection elements from being able to rotate with respect to the plates to which they are fixed.

To this end, in a preferred embodiment the connection elements each have a pair of second lower apertures and/or a pair of second upper apertures which face a pair of first upper apertures which are defined in the plates of the first machine and/or a pair of first lower apertures which are defined in the plates of the second machine, respectively.

It is also possible to add additional machines above the second machine so as to provide a modular system, the capacity of which is adaptable in accordance with the number of machines which it is desirable to store. Naturally, the term "machine" in this context is intended to be understood in particular to be an agricultural machine. Furthermore, it may be noted that the concepts which are set out above with reference to the first and second machines and the connection device therebetween also apply mutatis mutandis to any additional machine and any additional connection device. For example, the storage system may comprise a third machine which is arranged in a vertically higher position with respect to the second machine, a second connection device which is interposed between the second machine and the third machine so as to support the third machine overlapping the second machine, and, where applicable, connection means, preferably reversible connection means, between the second connection device and the second and third machines.

BRIEF DESCRIPTION OF THE DRAWINGS

The features and advantages of the invention will be better understood from the detailed description of a preferred embodiment thereof, which is illustrated by way of non-limiting example with reference to the appended drawings, in which.

PREFERRED EMBODIMENT OF THE INVENTION

Figure 1:
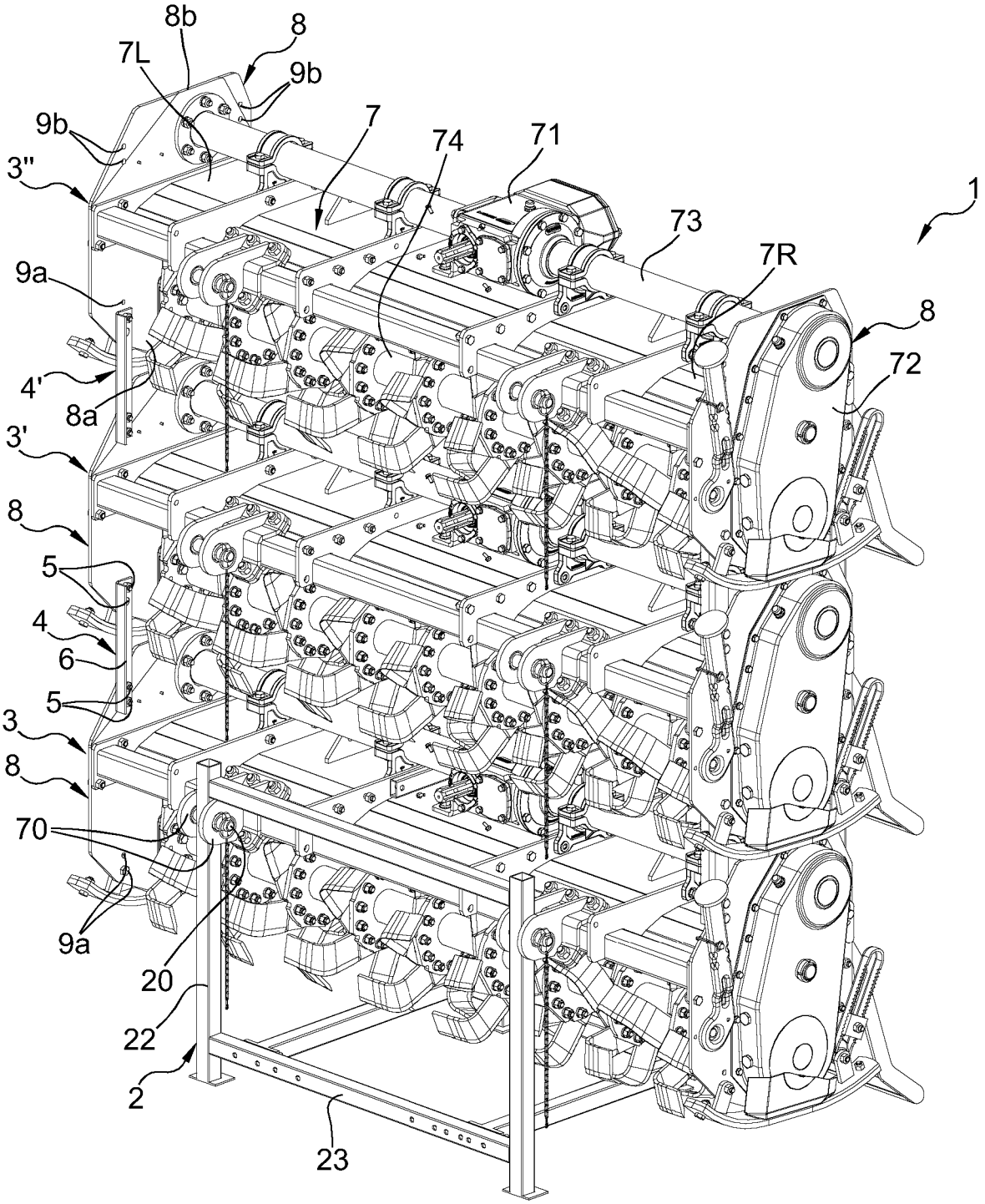
FIG. 1 shows a column storage system between agricultural machines according to the present invention.
Figure 2:
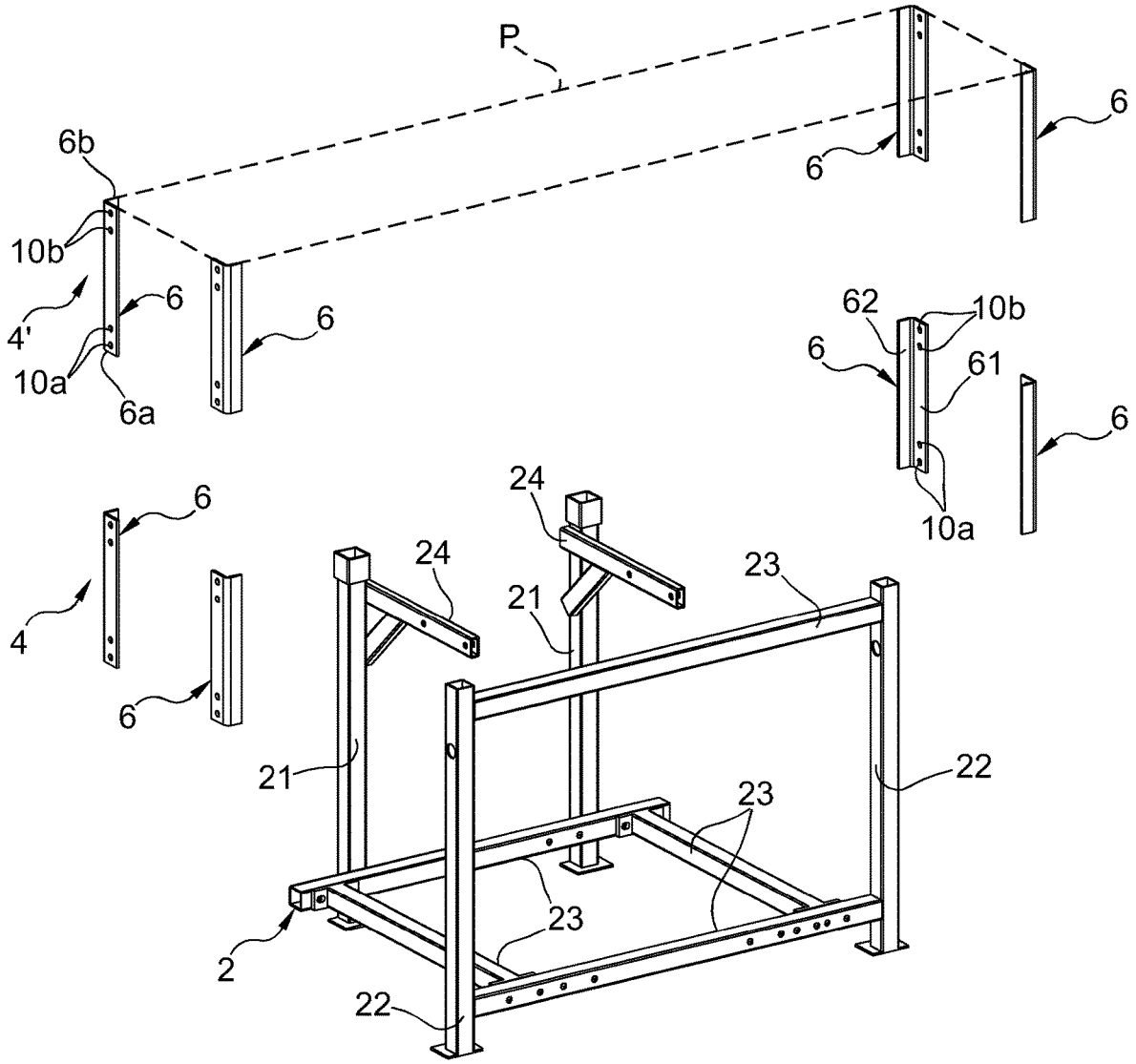
FIG. 2 illustrates a detail of FIG. 1.

In the embodiment of FIG. 1, there is generally designated 1 a column storage system between agricultural machines, more particularly rotary tillers. Below, the concepts relating to the storage device 1 are therefore tendentially set out with reference to the structure of rotary tillers. However, the rotary tillers may be replaced by other types of machines, for example, shredders or rotary harrows, therefore the concepts of the invention are not limited to rotary tillers but also apply to other types of agricultural machines having different forms and dimensions.

In the present embodiment, the storage system 1 comprises a first, a second and a third machine 3, 3', 3" which are arranged in columns, that is to say, one above the other. Naturally, in some embodiments, there may be only two or four or five machines in accordance with the specific storage and shipping requirements thereof.

The machines 3, 3', 3" each comprise a central body 7, which preferably extends longitudinally, and which where applicable has flanges 70 which can configure an attachment for an agricultural tractor (not illustrated). A main gearbox 71 which is configured to draw the movement from a power take-off of the agricultural tractor can be mounted on the central body 7.

Furthermore, the machines preferably each comprise a pair of plates 8 which extend transversely relative to the longitudinal extent of the central body 7 and which are fixed to the opposing longitudinal ends 7L, 7R thereof. There can be mounted on at least one of the plates 8 a respective lateral gearbox 72 which draws the movement from the main gearbox 71 by means of a transmission shaft 73 which extends from the main gearbox 71 to the lateral gearbox 72.

In the present embodiment, each machine 3, 3', 3" further comprises a tool-holder shaft 74 which extends from one plate 8 to the other in a direction parallel with the development of the central body 7. The tool-holder shaft 74 is rotatably secured to the plates 8 at the individual opposing ends and draws movement from the lateral gearbox 72.

The first machine 3 is supported on a ground support structure 2 which preferably comprises a plurality of beams 21-24 which are connected to each other. More particularly, the structure 2 has a quadrangular plan at the vertices of which there are arranged respective carrier beams 21, 22 (four in the present example) which have a vertical development and which are connected to each other by means of secondary beams 23 which extend transversely to the carrier beams.

The first machine 3, in particular the central body 7 thereof, is preferably supported on a pair of horizontal beams 24 which project from a pair of first carrier beams 21 which are arranged at one of the sides of the support structure 2.

In order to maintain the first machine 3 in position, it is preferable for it to also be supported on a pair of second carrier beams 22 which are arranged at the side opposite the structure 2. It is further preferable for the flanges 70 of the first machine 3 to be fixed to the pair of second carrier beams 22 by means of a retaining pin 20.

The beams 21-24 preferably have a closed cross-section, for example, square or rectangular, which allows effective support of the weight of a plurality of machines.

The machines contribute to providing the individual storage system 1 as a result of the provision of a first column connection device 4 between the first and second machines 3, 3' and in the present embodiment also a second column connection device 4' between the second and third machines 3', 3".

In practice, the first machine 3 is interposed between the ground support structure 2 and the first connection device 4 which in turn is interposed between the first machine and the second machine 3, 3'. Furthermore, in the present embodiment, the second machine 3' is interposed between the first connection device 4 and the second connection device 4' which is in turn interposed between the second machine and the third machine 3', 3".

The concepts relating to the storage device 1 are set out below mainly with reference to the first and second machines 3, 3' and the first connection device 4. However, these concepts are not limited to the first and second machines and the first connection device, but instead also apply mutatis mutandis to the third machine 3" and the second connection device 4'.

Each connection device 4, 4' preferably comprises a plurality of connection elements 6 (four in the present embodiment) which are constituted, for example, by metal profiles. The connection elements 6 extend from one machine to another in a preferably vertical direction and are arranged where applicable at the vertices of the perimeter P which is defined by the machines. Naturally, this example is not limiting. In embodiments, the connection device 4, 4' may comprise two connection elements 6 which are arranged, for example, at one-third and two-thirds of the longitudinal extent of the respective machine, respectively. In an additional embodiment, the connection device 4, 4' may comprise three connection elements 6 which are arranged, for example, at a quarter and three-quarters of the longitudinal extent of the respective machine. In order to prevent the occurrence of possible friction between one machine and another during transport, it is preferable for the connection elements 6 to keep the machines raised and with spacing from each other.

The connection elements 6 can be fixed to the machines, in particular to the plates 8, by reversible connection means 5, such as screws, bolts and/or retaining pins. More particularly, the connection elements 6 are fixed to pairs of vertically consecutive plates 8 between which they are interposed. There are preferably provided at least two connection elements 6 for each pair of vertically consecutive plates 8 and therefore preferably at least four connection elements for each pair of vertically consecutive machines 3, 3'. Naturally, in order to ensure the structural stability of the system, it is preferable for the connection elements 6 which are fixed to the same pair of plates 8 to be spaced apart from each other, particularly in a horizontal direction transversely relative to the longitudinal extent of the central body 7 of the machines.

In order to fix the connection elements 6 to the plates 8, the latter preferably have first apertures 9*a*, 9*b* which face second apertures 10*a*, 10*b* which are formed in the connection elements 6 in order to receive the reversible connection means 5. In one preferred embodiment, the reversible connection means 5 are therefore inserted between the first and second mutually facing apertures of the plates 8 and the connection elements 6, respectively.

In some embodiments, the connection elements 6 have an L-shaped cross-section comprising a first side 61 which adheres to the plates 8 and a second side 62 which is transverse relative to the first side. The second apertures 10*a*, 10*b* are preferably defined at the first side 61 which adheres to the plates. Preferably, the plates 8 have a vertical development and each have a lower longitudinal end 8*a* and an upper longitudinal end 8*b* which are opposite and in the region of which a plurality of first lower apertures 9*a* and a plurality of first upper apertures 9*b* are defined, respectively.

Preferably, the connection elements 6 also have a vertical development and each have a lower longitudinal end 6*a* and an upper longitudinal end 6*b* which are opposite and in the region of which a pair of second lower apertures 10*a* and a pair of second upper apertures 10*b* are defined, respectively.

The lower longitudinal ends 6*a* of the connection elements can be connected to the upper longitudinal ends 8*b* of the plates of the first machine 3 with the addition of the reversible connection means 5 to be inserted in the first upper apertures 9*b* and in the second lower apertures 10*a* which face each other. Similarly, the upper longitudinal ends 6*b* of the connection elements can be connected to the lower longitudinal ends 8*a* of the corresponding plates (that is to say, vertically consecutive) of the second machine 3', still with the aid of reversible connection means 5 to be inserted in the first lower apertures 9*a* and in the second upper apertures 10*b* which face each other.

It is preferable for the first apertures 9*a*, 9*b* and/or the second apertures 10*a*, 10*b* to be in the form of holes, particularly through-holes. It is further preferable for the holes of the first and second apertures which face each other to be coaxial in order to receive therein a screw, bolt, retaining pin or other reversible connection means 5. In a preferred embodiment, the reversible connection means 5 are therefore inserted between mutually facing and coaxial holes of the plates and the connection elements, respectively, The invention thereby solves the problem set out, achieving a number of advantages including a substantial saving of material and a greater flexibility in storage of the machines.

The invention claimed is:

1. A column storage system for agricultural machines, comprising:

a ground support structure, a first machine which is supported on the ground support structure, at least a second machine which is arranged in a vertically higher position with respect to the first machine, a connection device which is interposed between the first and the second machines so as to support the second machine overlapping the first machine, the connection device including a plurality of beam-shaped connection elements which extend longitudinally from the first machine to the second machine, and fastening elements which are configured to removably fix the connection device to the first and second machines, the connection device being fixed directly to the first machine, through which the connection device is fixed indirectly to the ground support structure.

2. The storage system according to claim 1, wherein each of the machines, when viewed from above, defines a perimeter, the connection device comprising a plurality of connection elements which are arranged at the vertices of the perimeter.

3. The storage system according to claim 2, wherein each of the machines, when viewed from above, extends longitudinally.

4. The storage system according to claim 1, wherein the plurality of connection elements comprises four connection elements.

5. The storage system according to claim 1, wherein the connection elements are spaced apart from each other.

6. The storage system according to claim 1, wherein each of the machines comprises a central body which extends longitudinally and a pair of plates which are arranged transversely with respect to the longitudinal development of the central body, the plates being fixed to the opposing longitudinal ends of the central body, the connection elements being fixed to the plates.

7. The storage system according to claim 6, wherein the plates have first apertures facing second apertures formed in the connection elements in order to receive the fastening elements therein.

8. The storage system according to claim 7, wherein the connection elements are constituted by metal profiles having an L-shaped section in which there are defined a first side adhering to the plates and a second side transverse with respect to the first side, the second apertures being defined at the first side.

9. The storage system according to claim 6, wherein the plates have a vertical development and each have a lower longitudinal end and an upper longitudinal end which are opposite each other and at which there are defined at least a first lower aperture for fixing a connection element which is arranged below the plate and at least a first upper aperture for fixing a connection element which is arranged above the plate, respectively.

10. The storage system according to claim 9, wherein the connection elements have a vertical development and each have a lower longitudinal end and an upper longitudinal end which are opposite each other and at which there are defined at least a second lower aperture facing the at least one first upper aperture of a plate which is arranged below the connection element and at least a second upper aperture facing the at least one first lower aperture of a plate which is arranged above the connection element in order to receive the fastening elements therein, respectively.

11. The storage system according to claim 9, wherein at least one of the opposing longitudinal ends of each connection element and at least one of the opposing longitudinal ends of each plate have a pair of second apertures and a pair of first apertures, respectively, which face each other in order to receive the fastening elements therein so as to secure the connection elements to the plates without any capacity for relative rotation.

12. The storage system according to claim 1, comprising a third machine which is arranged in a vertically higher position with respect to the second machine, a second connection device which is interposed between the second machine and the third machine so as to support the third machine overlapping the second machine, and fastening elements between the second connection device and the second and third machines.

13. The storage system according to claim 1, wherein each of the machines, when viewed from above, defines a perimeter, wherein the connection elements are arranged at the vertices of the perimeter.

14. The storage system according to claim 13, wherein the plurality of connection elements comprises four connection elements.

15. The storage system according to claim 13, wherein the connection elements are spaced apart from each other.

16. The storage system according to claim 1, wherein the connection elements have an L-shaped section in which there are defined a first side adhering to the first machine and the second machine, and a second side transverse with respect to the first side.

17. A column storage system for agricultural machines, comprising:

a ground support structure, a first machine which is supported on the ground support structure, at least a second machine which is arranged in a vertically higher position with respect to the first machine, a connection device which is interposed between the first and the second machines so as to support the second machine overlapping the first machine, and fastening elements which are configured to removably fix the connection device to the first and second machines, the connection device being fixed directly to the first machine, through which the connection device is fixed indirectly to the ground support structure, wherein the connection device comprises a plurality of beam-shaped connection elements which extend longitudinally from the first machine to the second machine, wherein each of the machines, when viewed from above, defines a perimeter, the connection elements being arranged at the vertices of the perimeter.

18. The storage system according to claim 17, wherein each of the machines comprises a central body which extends longitudinally and a pair of plates which are arranged transversely with respect to the longitudinal development of the central body, the plates being fixed to the opposing longitudinal ends of the central body, the connection elements being fixed to the plates.

19. The storage system according to claim 18, wherein the plates have first apertures facing second apertures formed in the connection elements in order to receive the fastening elements therein.

20. A column storage system for agricultural machines, comprising:

a ground support structure, a first machine which is supported on the ground support structure, at least a second machine which is arranged in a vertically higher position with respect to the first machine, a connection device which is interposed between the first and the second machines so as to support the second machine overlapping the first machine, and fastening elements which are configured to removably fix the connection device to the first and second machines, the connection device being fixed directly to the first machine, through which the connection device is fixed indirectly to the ground support structure, wherein the connection device comprises a plurality of beam-shaped connection elements which extend longitudinally from the first machine to the second machine, wherein each of the machines, when viewed from above, defines a perimeter, the connection elements being arranged at the vertices of the perimeter, wherein the plurality of connection elements comprises four connection elements which are spaced apart from each other, wherein each of the machines comprises a central body which extends longitudinally and a pair of plates which are arranged transversely with respect to the longitudinal development of the central body, the plates being fixed to the opposing longitudinal ends of the central body, the connection elements being fixed to the plates.

* * * * *